US009125458B2

(12) United States Patent
Grimm et al.

(10) Patent No.: US 9,125,458 B2
(45) Date of Patent: Sep. 8, 2015

(54) MULTI-DIRECTIONAL BUCKLE ASSEMBLY

(71) Applicant: ILLINOIS TOOL WORKS INC., Glenview, IL (US)

(72) Inventors: Michael B. Grimm, Evanston, IL (US); Christopher A. J. Iannello, Rolling Meadows, IL (US); Martin J. Nilsen, Hampshire, IL (US); Jon D. Burrow, Bartlet, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 14/404,487

(22) PCT Filed: Jun. 3, 2013

(86) PCT No.: PCT/US2013/043930

§ 371 (c)(1),
(2) Date: Nov. 28, 2014

(87) PCT Pub. No.: WO2013/184594

PCT Pub. Date: Dec. 12, 2013

(65) Prior Publication Data

US 2015/0135483 A1 May 21, 2015

Related U.S. Application Data

(60) Provisional application No. 61/656,074, filed on Jun. 6, 2012, provisional application No. 61/701,035, filed on Sep. 14, 2012.

(51) Int. Cl.

| | |
|---|---|
| ***A44B 11/25*** | (2006.01) |
| ***A44B 11/00*** | (2006.01) |
| ***A44B 11/26*** | (2006.01) |

(52) U.S. Cl.

CPC ..... *A44B 11/2592* (2013.01); *A44B 11/006* (2013.01); *A44B 11/2596* (2013.01); *A44B 11/266* (2013.01)

(58) Field of Classification Search

CPC .... A44B 11/266; A44B 11/006; A44B 11/04; A44B 11/10; A44B 11/2526; A44B 11/2561; A44B 11/2592; A44B 11/263; Y10T 24/45524; Y10T 24/45581; Y10T 24/45529; Y10T 24/4084; Y10T 24/4019; Y10T 24/4093; Y10T 24/45534; Y10T 24/45623; Y10T 24/457

USPC ..... 24/171, 200, 265 BC, 614, 615, 616, 24/625, 633, 664

See application file for complete search history.

(56) References Cited

U.S. PATENT DOCUMENTS 3,336,641 A * 8/1967 Hunter ..... 24/653
3,921,262 A * 11/1975 Tanaka ..... 24/637

(Continued)

FOREIGN PATENT DOCUMENTS

WO 2012162615 A2 11/2012

OTHER PUBLICATIONS

ISR and WO for PCT/US2013/043930 mailed Oct. 29, 2013.

*Primary Examiner* — Robert J Sandy
*Assistant Examiner* — David Upchurch

(57) ABSTRACT

A female buckle member is configured to securely mate with a male buckle member and adjustably retain webbing through multiple directions. The female buckle member may include a housing having first and second ends and first and second sides. A base of the housing may include a base connected to opposed lateral walls and an upper wall. An insertion channel is defined between the base, the opposed lateral walls, and an upper wall. The housing may be symmetrical about longitudinal and lateral axes. The first and second ends of the housing may have the same size and shape. The first and second ends are configured to receive an insertion end of a male buckle member. The female buckle member may also include a plurality of web-retainers that define a first web-retaining channel configured to adjustably retain webbing extending between the first and second ends, and a second web-retaining channel configured to adjustably retain webbing extending between the first and second sides.

19 Claims, 10 Drawing Sheets

(56) References Cited

U.S. PATENT DOCUMENTS

| | | | | |
|---|---|---|---|---|
| 5,438,737 | A * | 8/1995 | Anscher et al. | 24/630 |
| 5,465,472 | A | 11/1995 | Matoba | |
| 5,604,964 | A * | 2/1997 | Aoshima | 24/632 |
| 5,709,014 | A * | 1/1998 | Takahashi | 24/614 |
| 6,061,883 | A * | 5/2000 | Uehara | 24/625 |
| 6,393,677 | B1 * | 5/2002 | Anscher | 24/630 |
| 6,408,494 | B1 * | 6/2002 | Anscher | 24/625 |
| 6,711,790 | B2 * | 3/2004 | Pontaoe | 24/633 |
| 7,296,327 | B2 | 11/2007 | Anderson et al. | |
| 7,302,742 | B2 | 12/2007 | Pontaoe | |
| 7,331,088 | B2 | 2/2008 | Pontaoe | |
| 8,256,073 | B2 * | 9/2012 | Zhang | 24/634 |
| 2002/0017012 | A1 * | 2/2002 | Sack et al. | 24/633 |
| 2003/0106191 | A1 | 6/2003 | Cheng | |
| 2004/0221432 | A1 * | 11/2004 | Nezu | 24/614 |
| 2007/0089280 | A1 | 4/2007 | Pontaoe | |
| 2008/0028579 | A1 * | 2/2008 | Chen | 24/625 |
| 2008/0078069 | A1 | 4/2008 | Pontaoe | |
| 2008/0222860 | A1 | 9/2008 | Pontaoe | |
| 2009/0255101 | A1 * | 10/2009 | Lin | 24/614 |
| 2012/0054993 | A1 * | 3/2012 | Anscher | 24/634 |
| 2014/0096348 | A1 | 4/2014 | Anderson et al. | |

* cited by examiner

MULTI-DIRECTIONAL BUCKLE ASSEMBLY

RELATED APPLICATIONS

The present application is a National Phase of International Application No. PCT/US2013/043930 filed Jun. 3, 2013 and relates to and claims priority benefits from U.S. Provisional Patent Application No. 61/656,074 filed Jun. 6, 2012, and U.S. Provisional Patent Application No. 61/701,035 filed Sep. 14, 2012, both of which are hereby incorporated by reference in their entireties.

FIELD OF EMBODIMENTS OF THE DISCLOSURE

Embodiments of the present disclosure generally relate to a buckle assembly, and, more particularly, to a female buckle member configured to securely connect to a male buckle member and webbing in multiple orientations.

BACKGROUND

Buckles are used to securely connect components together. For example, various bags, backpacks, and the like have male and female buckle members connected to straps, webbing, or the like. Each strap, for example, is looped through a web-retaining channel on a buckle member. In order to connect the looped straps together, the make buckle member is connected to the female buckle member.

A conventional side-release buckle assembly may include a male connection member that is configured to mate with a female connection member, such as shown and described in U.S. Pat. No. 5,465,472, entitled "Buckle." Each connection member is configured to retain a strap, such as a seatbelt or backpack strap. The male connection member includes integral buttons that may be engaged to release the male connection member from the female connection member, thereby disconnecting the buckle assembly.

Typically, a male buckle member having a latching device enters a reciprocal female buckle member from a first direction. Accordingly, one or both of the buckle members has a facing configured for proper mating. Additionally, a typical female buckle member has a housing that is configured to cover the latching device of the male buckle member when connected, thereby adding material and cost to the male buckle member.

In general, known buckle assemblies are configured to mate in a single direction. That is, a female buckle member receives the male connection member from one direction. Additionally, the buckle members are typically configured to retain a strap or webbing in a single orientation, which may limit the use of the buckle members.

SUMMARY OF EMBODIMENTS OF THE DISCLOSURE

Certain embodiments of the present disclosure provide a female buckle member configured to securely mate with a male buckle member. The female buckle member may include a housing having a base connected to opposed lateral walls and an upper wall. An insertion channel is defined between the base, the opposed lateral walls, and an upper wall. The housing may be symmetrical about longitudinal and lateral axes. First and second ends of the housing may have the same size and shape. The first and second ends are configured to receive an insertion end of a male buckle member.

The female buckle member may also include at least one male lock member extending from the base. The male lock member(s) is configured to securely connect to a reciprocal feature of the male buckle member. The at least one male lock member may include two opposed male lock members extending toward one another from the opposed lateral walls. The male lock member(s) may include rounded corners connected to an exposed end.

The female buckle member may also include a plurality of web-retainers extending from the base. The plurality of web-retainers are configured to adjustably retain webbing. The plurality of web-retainers may define web-retaining channels formed through the first and second ends of the housing. The plurality of web-retainers may also define web-retaining channels formed through first and second sides of the housing. Each of the plurality of web-retainers may include an extension beam connected to the base and a cross beam extending inwardly from the extension beam. In other embodiments, each of the plurality of web-retainers may include a retaining spade extending toward a central axis of the housing.

Certain embodiments of the present disclosure provide a female buckle member configured to securely mate with a male buckle member. The female buckle member may include a housing having first and second ends, first and second sides, and a base. A plurality of web-retainers may extend from the base. The plurality of web-retainers define a first web-retaining channel configured to adjustably retain webbing extending between the first and second ends, and a second web-retaining channel configured to adjustably retain webbing extending between the first and second sides. The first web-retaining channel is parallel to one of a longitudinal or lateral axis of the housing, and the second web-retaining channel is parallel to the other of the longitudinal or lateral axis of the housing.

Each of the plurality of web-retainers may include a retaining spade extending toward a central axis of the housing. The retaining spade may include a central rib and side fins on either side of the central rib. The central rib may taper down from an outer edge to a distal tip. Each of the side fins may be widest proximate to a mid-section of the retaining spade.

Certain embodiments of the present disclosure provide a female buckle member configured to securely mate with a male buckle member and adjustably retain webbing through multiple directions. The female buckle member may include a housing having first and second ends and first and second sides. The housing may include a base connected to opposed lateral walls and an upper wall. An insertion channel is defined between the base, the opposed lateral walls, and an upper wall. The housing may be symmetrical about longitudinal and lateral axes. First and second ends of the housing may have the same size and shape. The first and second ends may be configured to receive an insertion end of a male buckle member. The female buckle member may also include a plurality of web-retainers extending from the base. The plurality of web-retainers define a first web-retaining channel configured to adjustably retain webbing extending between the first and second ends, and a second web-retaining channel configured to adjustably retain webbing extending between the first and second sides. The first web-retaining channel is parallel to one of the longitudinal or lateral axis of the housing. The second web-retaining channel is parallel to the other of the longitudinal or lateral axis of the housing.

Figure 1:
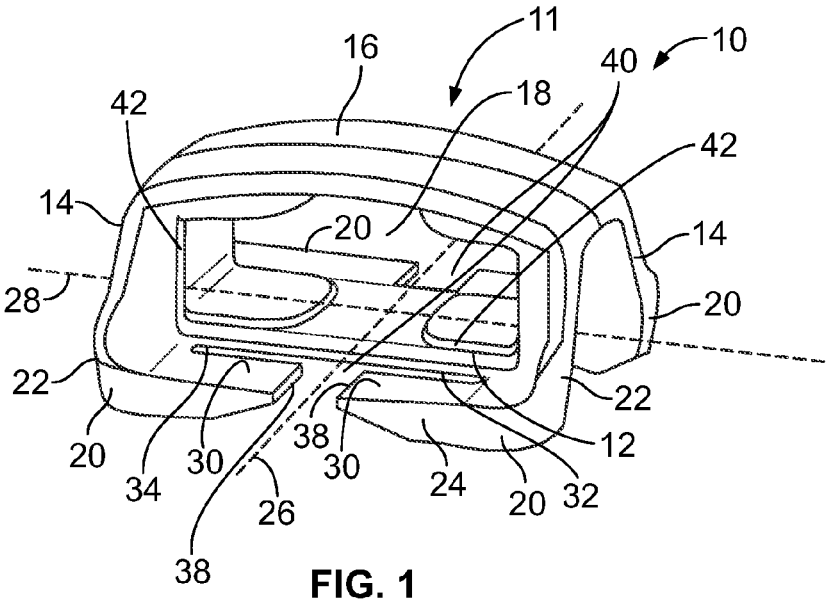
FIG. 1 illustrates an isometric top view of a female buckle member, according to an embodiment of the present disclosure.

Before the embodiments of the disclosure are explained in detail, it is to be understood that the disclosure is not limited in its application to the details of construction and the arrangement of the components set forth in the following description or illustrated in the drawings. The disclosure is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF EMBODIMENTS OF THE DISCLOSURE

Certain embodiments of the present disclosure provide a female buckle member configured to receive and securely retain a male buckle member from either end. As such, the female buckle member is not limited to a particular position or orientation with respect to a component and/or the male buckle member. Embodiments of the present disclosure provide a bi-directional web-mounted side release buckle housing having a low profile. Accordingly, embodiments provide greater flexibility when orienting buckle members. Additionally, embodiments provide a female buckle member having a housing with less material than many known female buckle members. Further, certain embodiments of the present disclosure provide a female buckle member that is configured to receive webbing from either end or either side. It is to be understood that the terms web or webbing refer to webbing, straps, ropes, fabric, sheets, or the like that are configured to be adjustably secured by a female or buckle member.

FIG. 1 illustrates an isometric top view of a female buckle member 10, according to an embodiment of the present disclosure. The female buckle member 10 may be integrally formed and molded as a single piece of injection-molded plastic, for example. Optionally, the female buckle member 10 may be formed of various other materials, such as metal.

The female buckle member 10 includes a housing 11 having a base 12 integrally connected to opposed lateral walls 14, which, in turn, integrally connect to an upper wall 16. The upper wall 16 may be formed as an arch, as shown in FIG. 1. Alternatively, the upper wall 16 may be straight, downwardly-bowed, or the like. An insertion channel 18 is defined between the base 12, the lateral walls 14, and the upper wall 16. The insertion channel 18 is configured to receive a male buckle member (not shown in FIG. 1).

Web-retainers 20 extend downwardly from each corner of the base 12. Each web-retainer 20 includes an extension beam 22 that extends downwardly from the base 12. The extension beam 22 integrally connects to a crossbeam 24 that may generally be perpendicular to the extension beam 22. Each crossbeam 24 may extend toward a central lateral axis 26 of the female buckle member 10. The central lateral axis 26 is perpendicular to a central longitudinal axis 28 of the female buckle member 10.

The crossbeams 24 may include planar upper surfaces 30 that are offset from front and rear ends of the base 12. Additionally, the planar upper surfaces 30 may be positioned below a lower surface 32 of the base 12 such that a clearance area 34 is formed between a plane that contains the planar upper surfaces 30 and a plane that contains the lower surface 32. However, the planar upper surfaces 30 may be positioned at the same level as, or above the level of, the lower surface 32 of the base 12. Webbing is configured to be adjustably retained within the clearance area 34. Additionally, distal tips 38 of opposed crossbeams 24 are separated by gaps 40. The gaps 40 allow the webbing to be moved into the clearance area 34. Alternatively, the gaps 40 may be omitted, such that two contiguous crossbeams (instead of the four separate and distinct crossbeams 24 shown in FIG. 1) are formed proximate to each end of the female buckle member 10.

Male locking ledges 42 extend upwardly from the base 12 into the insertion channel 18. The male locking ledges 42 are configured to securely retain reciprocal portions of a male buckle member.

Figure 2:
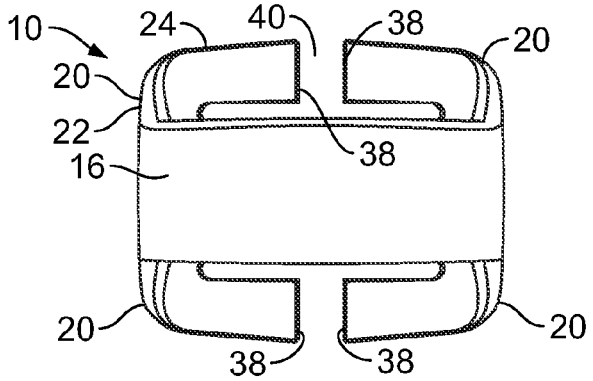
FIG. 2 illustrates a top view of a female buckle member, according to an embodiment of the present disclosure.

FIG. 2 illustrates a top view of the female buckle member 10, according to an embodiment of the present disclosure. As shown in FIG. 2, the distal tips 38 of opposed crossbeams 24 are separated by gaps 40. Further, the crossbeams 24 may be outwardly offset from the ends of the base 12 (hidden from view in FIG. 2). Optionally, the crossbeams 24 may be positioned directly underneath the base 12.

Figure 3:
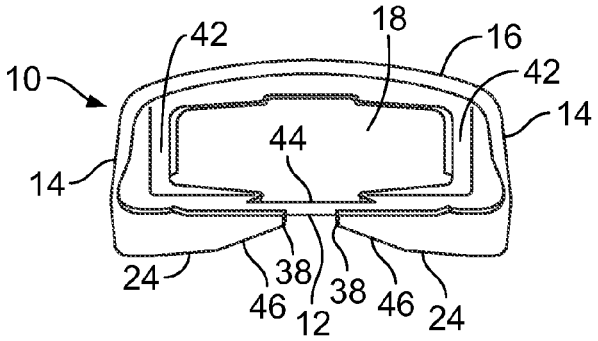
FIG. 3 illustrates an end view of a female buckle member, according to an embodiment of the present disclosure.

FIG. 3 illustrates an end view of the female buckle member 10, according to an embodiment of the present disclosure. The male locking ledges 42 extend from a junction of the base 12 and a lateral wall 14. Each male locking ledge 42 extends upwardly from the base 12 within the insertion channel 18. The male locking ledges 42 are opposed, mirror, and extend toward one another. A central channel 44 is formed between the opposed male locking ledges 42. Optionally, the female buckle member 10 may not include the male locking ledges 42.

As shown in FIG. 3, each of the crossbeams 24 may include a lower ramped surface 46 that angles downwardly from the distal tip 38. As such, the crossbeams 24 may have beveled distal tips 38. The beveled distal tips 38 decrease the material of the female buckle member 10, thereby reducing weight and overall cost. Optionally, the distal tips 38 may not be angled or beveled.

Figure 4:
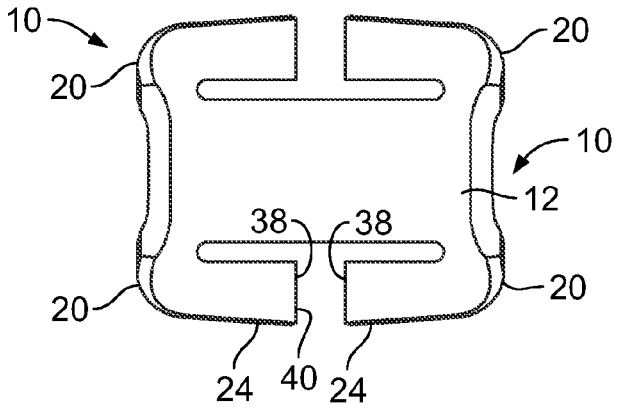
FIG. 4 illustrates a bottom view of a female buckle member, according to an embodiment of the present disclosure.

FIG. 4 illustrates a bottom view of the female buckle member 10, according to an embodiment of the present disclosure. Webbing (not shown) is configured to be inserted into a web passage defined by the web-retainers 20 and the base 12. For example, webbing may be adjustably secured over the web-retainers 20 and underneath the base 12.

Figure 5:
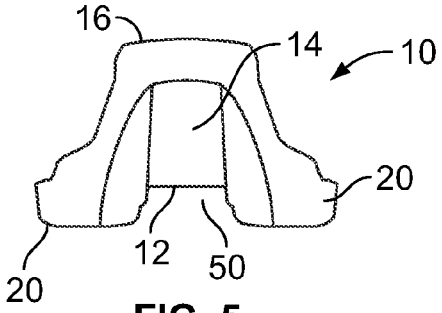
FIG. 5 illustrates a lateral view of a female buckle member, according to an embodiment of the present disclosure.

FIG. 5 illustrates a lateral view of the female buckle member 10, according to an embodiment of the present disclosure. As shown in FIG. 5, the web-retainers 20 may extend below a surface of the base 12. As such, a central lower recessed area 50 may be defined below the base 12. The recessed area 12 is configured to allow attachment across a Pouch Attachment Ladder System (PALS), which is a grid of webbing used particularly in military applications. PALS is used to attach smaller equipment onto load-bearing platforms, such as vests and backpacks. In general, PALS includes webbing sewn onto load-bearing equipment and corresponding webbing and straps on the attachment. The straps may be interwoven between the webbing on each piece and snapped into place, thereby providing a secure fit that may be detached when desired.

Figure 6:
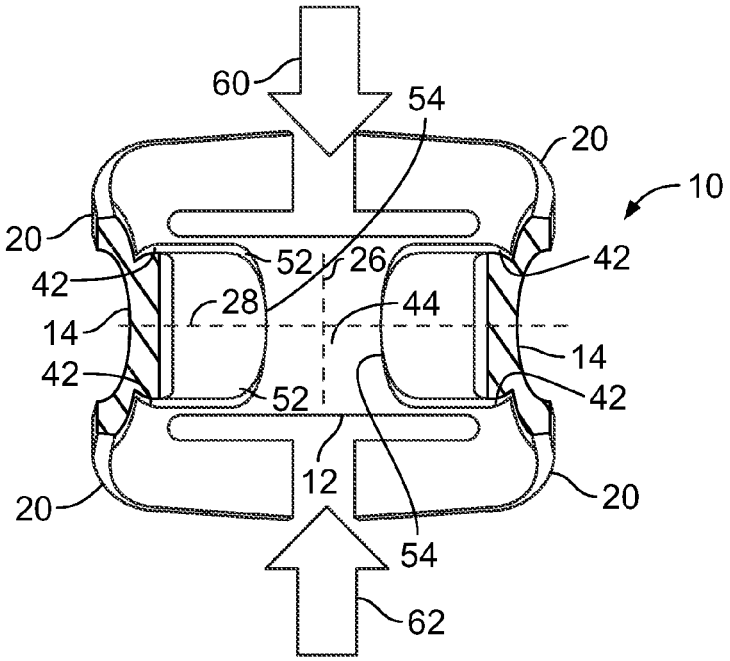
FIG. 6 illustrates an internal view of a base of a female buckle member, according to an embodiment of the present disclosure.

FIG. 6 illustrates an internal view of the base 12 of the female buckle member 10, according to an embodiment of the present disclosure. A male lock ledge 42 extends upwardly from the base 12 from each lateral wall 14. Each lock ledge 42 may be as wide as the base 12, and may include rounded corners 52 that connect to an exposed end 54 proximate to the central channel 44. Optionally, the lock ledges 42 may be more or less wide than the base 12, and/or include right angle corners connected to the exposed end 54. The male lock ledges 42 may mirror and oppose one another and are configured to securely latch and lock onto reciprocal features of a male buckle member, such as undersides of latch arms. The male lock ledges 42 are symmetrical with respect to the longitudinal axis 28 and mirror one another with respect to the lateral axis 26. In general, the female buckle member 10 is symmetrical about both axes 26 and 28, and, indeed, mirrors itself about the axes 26 and 28. Accordingly, the female buckle member 10 is configured to receive and securely retain an insertion end of a male buckle member from either end 60 or 62.

Figure 7:
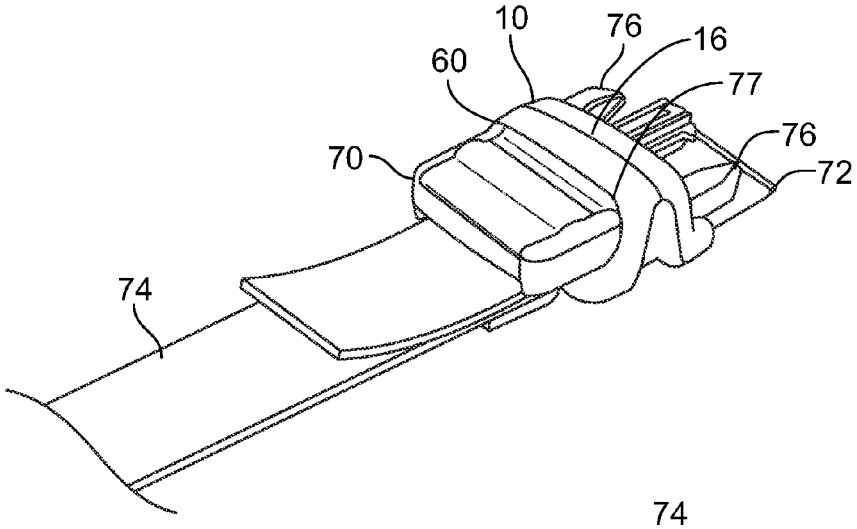
FIG. 7 illustrates an isometric top view of a female buckle member securely retaining a male buckle member from a first end, according to an embodiment of the present disclosure.

FIG. 7 illustrates an isometric top view of the female buckle member 10 securely retaining a male buckle member 70 from a first end 60, according to an embodiment of the present disclosure. The female buckle member 10 may adjustably retain webbing 72, while the male buckle member 70 may adjustably retain webbing 74. The male buckle member 70 may include opposed latching arms 76 that deflect inwardly as they pass into the insertion channel 18 (shown in FIG. 1, for example) and flex out into at-rest positions as they pass out of the insertion channel, thereby securely latching the male buckle member 70 to the female buckle member 10. The male lock ledges 42 (shown in FIGS. 1, 3, and 6) may securely mate with reciprocal features formed on the male buckle member 70 to provide additional securing strength. Alternatively, the female buckle member 10 may not include the male lock ledges 42.

The male buckle member 70 may be further described and shown in, for example, U.S. Pat. No. 7,331,088, entitled "Buckle Assembly," U.S. Pat. No. 7,296,327, entitled "Buckle Assembly," U.S. Pat. No. 7,302,742, entitled "Side Release Buckle Assembly," PCT Publication WO2012/162615, entitled "Buckle Assembly," United States Patent Application Publication No. 2007/0089280, entitled "Side Release Buckle Assembly," United States Patent Application Publication No. 2008/0222860, entitled "Buckle Assembly," and United States Patent Application Publication No. 2008/0078069, entitled "Strap Adjusting Assembly," all of which are hereby incorporated by reference in their entireties.

Figure 8:
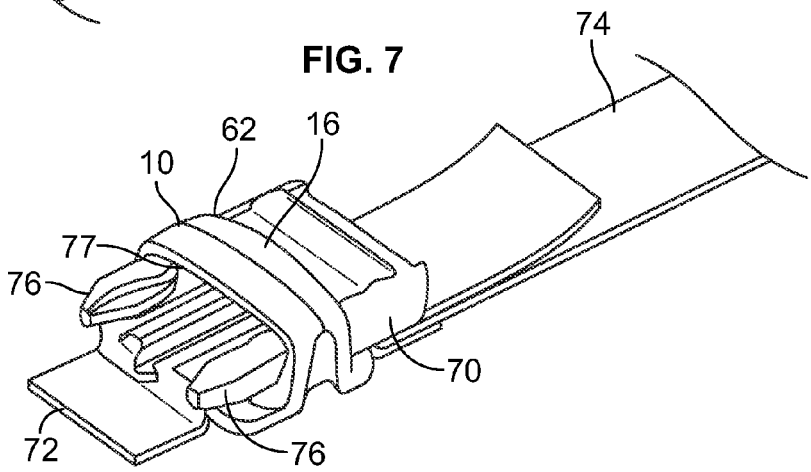
FIG. 8 illustrates an isometric top view of a female buckle member securely retaining a male buckle member from a second end, according to an embodiment of the present disclosure.

FIG. 8 illustrates an isometric top view of the female buckle member 10 securely retaining the male buckle member 70 from a second end 62, according to an embodiment of the present disclosure. Because the female buckle member 10 has ends 60 and 62 that mirror one another and are the same size and shape, the female buckle member 10 may receive the insertion end of male buckle member 70 from either end 60 and 62.

As shown in FIGS. 7 and 8, only the upper wall 16 of the female buckle member 10 covers a mid-section 77 of the male buckle member 70. The base and ends of the latching arms of the male buckle member 70 may be exposed. The female buckle member does not substantially cover the male buckle member 70. Instead, the female buckle member 10 is a light weight buckle member that is capable of securely retaining the male buckle member from either end. The female buckle member 10 includes a housing that securely and reliably connects to the male buckle member 70 from either end, while providing a light-weight, cost-effective design having less material than many known buckles.

Figure 9:
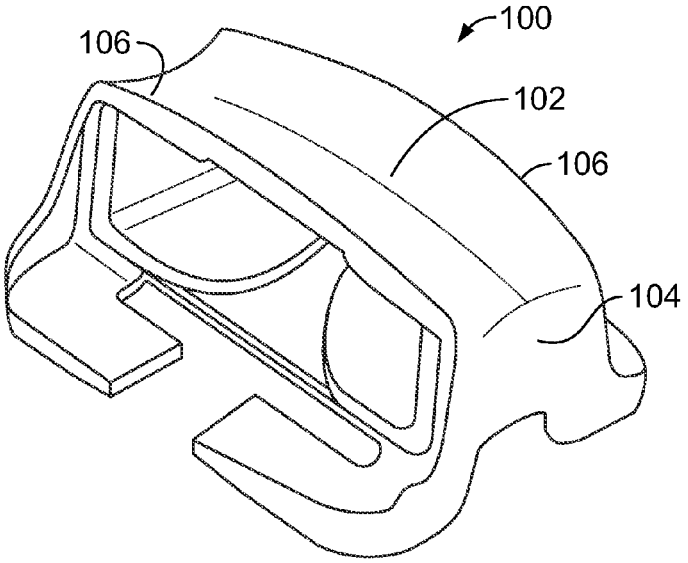
FIG. 9 illustrates an isometric top view of a female buckle member, according to an embodiment of the present disclosure.
Figure 10:
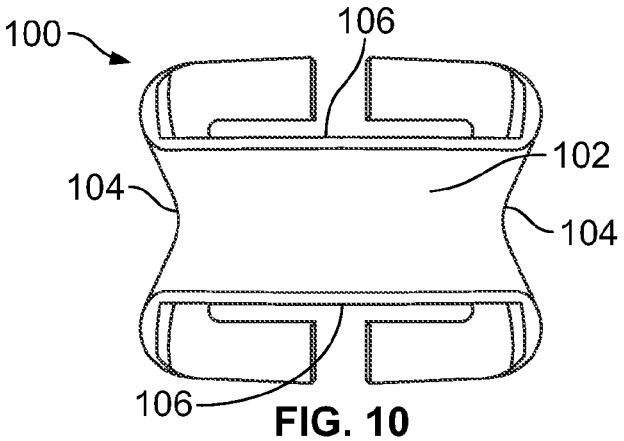
FIG. 10 illustrates a top view of a female buckle member, according to an embodiment of the present disclosure.
Figure 11:
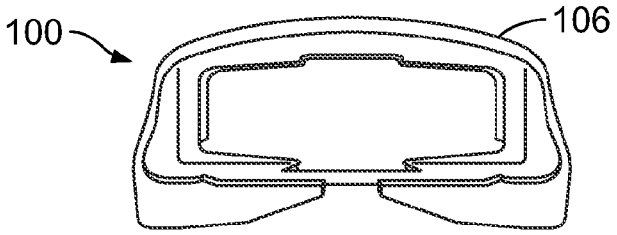
FIG. 11 illustrates an end view of a female buckle member, according to an embodiment of the present disclosure.
Figure 12:
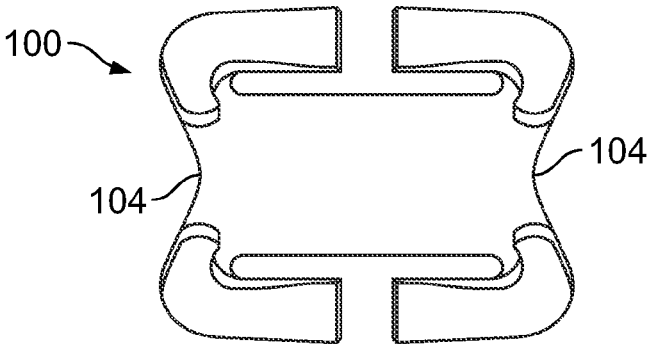
FIG. 12 illustrates a bottom view of a female buckle member, according to an embodiment of the present disclosure.
Figure 13:
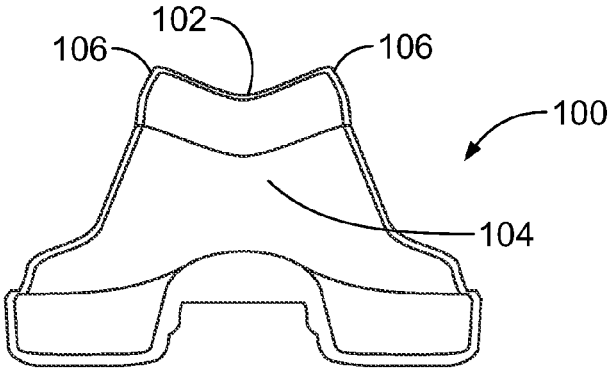
FIG. 13 illustrates a lateral view of a female buckle member, according to an embodiment of the present disclosure.

FIG. 9 illustrates an isometric top view of a female buckle member 100, according to an embodiment of the present disclosure. FIG. 10 illustrates a top view of the female buckle member 100. FIG. 11 illustrates an end view of the female buckle member 100. FIG. 12 illustrates a bottom view of the female buckle member 100. FIG. 13 illustrates a lateral view of the female buckle member 100. Referring to FIGS. 9-13, the female buckle member 100 is similar to the female buckle member 10, except that the female buckle member 100 includes a top wall 102 and lateral walls 104 bounded by outer rims 106 having inwardly bowed surfaces therebetween. The outer rims 106 provide support to the top wall 102 and the lateral walls 104, while the inwardly bowed surfaces provide an ergonomic engagement area configured to allow a user to easily grasp.

Figure 14:
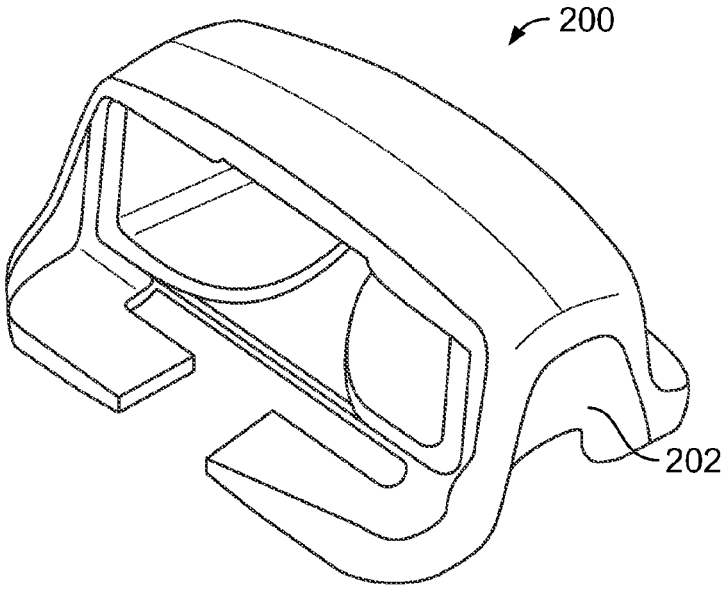
FIG. 14 illustrates an isometric top view of a female buckle member, according to an embodiment of the present disclosure.
Figure 15:
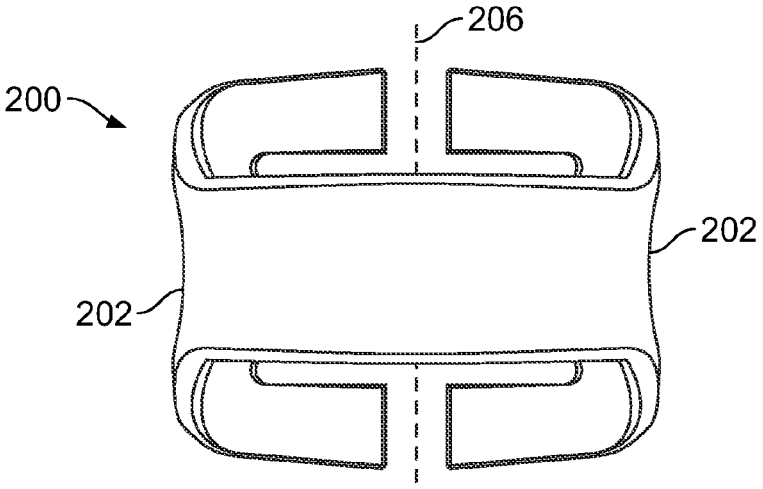
FIG. 15 illustrates a top view of a female buckle member, according to an embodiment of the present disclosure.
Figure 16:
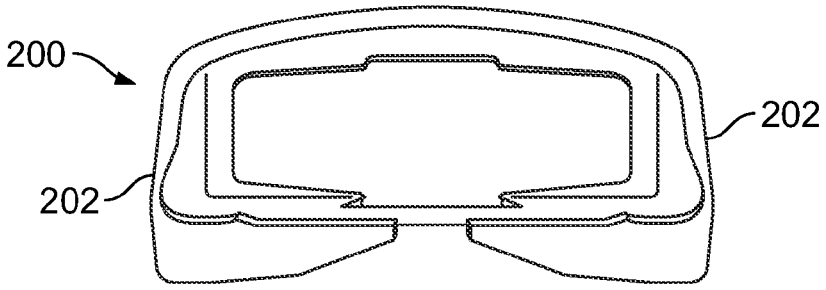
FIG. 16 illustrates an end view of a female buckle member, according to an embodiment of the present disclosure.
Figure 17:
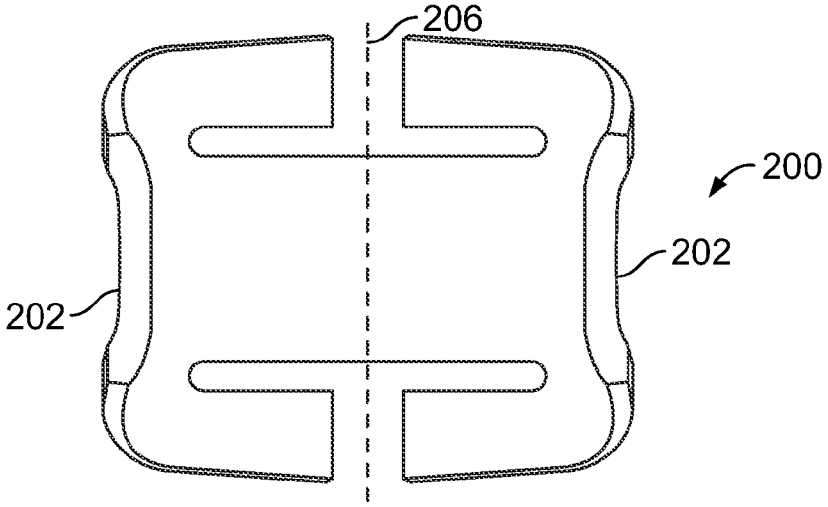
FIG. 17 illustrates a bottom view of a female buckle member, according to an embodiment of the present disclosure.
Figure 18:
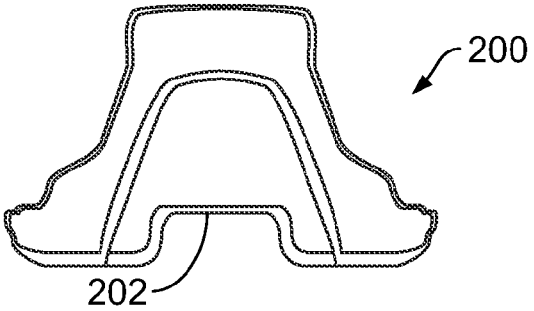
FIG. 18 illustrates a lateral view of a female buckle member, according to an embodiment of the present disclosure.

FIG. 14 illustrates an isometric top view of a female buckle member 200, according to an embodiment of the present disclosure. FIG. 15 illustrates a top view of the female buckle member 200. FIG. 16 illustrates an end view of the female buckle member 200. FIG. 17 illustrates a bottom view of the female buckle member 200. FIG. 18 illustrates a lateral view of the female buckle member 200. Referring to FIGS. 14-18, the female buckle member 200 is similar to the female buckle member 10, except that the female buckle member 200 includes lateral walls 202 that are set further in toward the lateral axis 206, thereby providing a female buckle member having less material weight.

Figure 19:
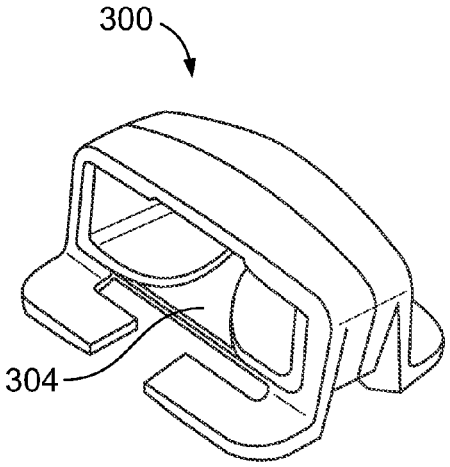
FIG. 19 illustrates an isometric top view of a female buckle member, according to an embodiment of the present disclosure.
Figure 20:
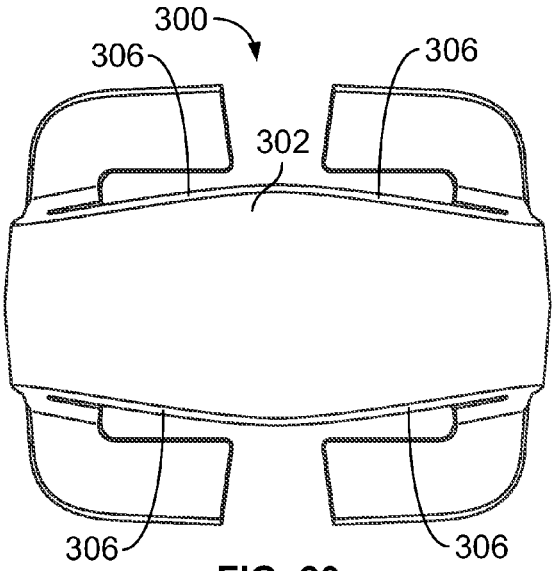
FIG. 20 illustrates a top view of a female buckle member, according to an embodiment of the present disclosure.
Figure 21:
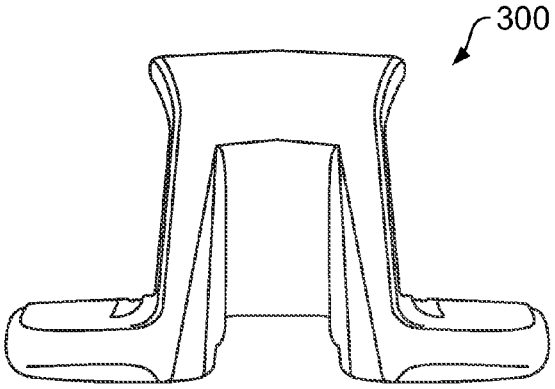
FIG. 21 illustrates an end view of a female buckle member, according to an embodiment of the present disclosure.

FIG. 19 illustrates an isometric top view of a female buckle member 300, according to an embodiment of the present disclosure. FIG. 20 illustrates a top view of the female buckle member 300. FIG. 21 illustrates an end view of the female buckle member 300. Referring to FIGS. 19-21, the female buckle member 300 is similar to the female buckle member 10, except that the female buckle member 300 includes a top wall 302 and base 304 having tapered ends 306, thereby providing a female buckle member having less material weight.

Unlike previous buckle assemblies, embodiments of the present disclosure provide a compact female buckle member that covers only areas of the latching arms of male buckle members between the webbing and lock ledges of the latching arms. Additionally, as noted above, unlike previous buckle assemblies, embodiments provide a female buckle member that is able to receive and retain the latching arms from either end. Embodiments provide a female buckle member that is compact and that is able to receive and retain a male buckle member from either end without having to reposition the female buckle member.

Figure 22:
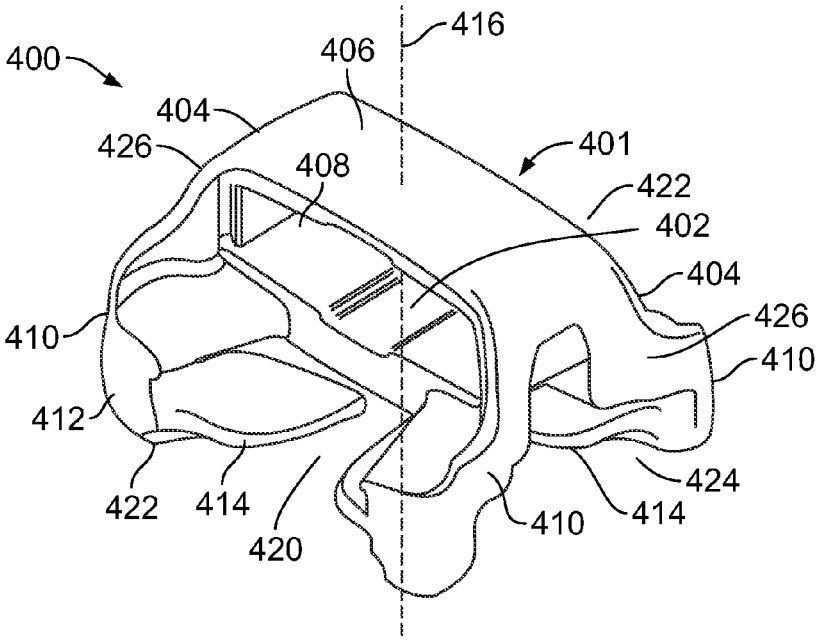
FIG. 22 illustrates an isometric top view of a female buckle member, according to an embodiment of the present disclosure.

FIG. 22 illustrates an isometric top view of a female buckle member 400, according to an embodiment of the present disclosure. The female buckle member 400 is similar to the female buckle member 10 in that the female buckle member 400 includes a housing 401 having a base 402 integrally connected to lateral walls 404, which, in turn, are integrally connected to a top wall 406. An insertion channel 408 is defined between the base 402, the lateral walls 404, and the top wall 406.

Web-retainers 410 extend downwardly from the four corners of the base 402. However, each web retainer 410 includes an extension beam 412 integrally connected to a planar retaining spade 414 that extends toward a central vertical axis 416 of the female buckle member 400. Accordingly, web-retaining channels 420 are defined at the ends 422 of the female buckle member 400, while web-retaining channels 424 are defined at the sides 426 of the female buckle member 400.

Figure 23:
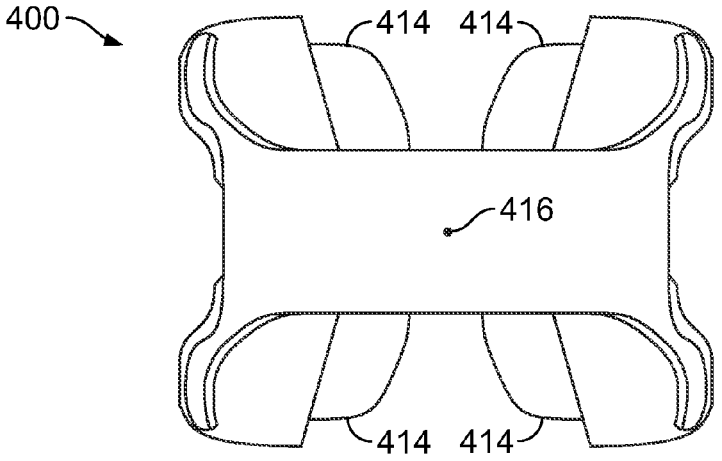
FIG. 23 illustrates a top view of a female buckle member, according to an embodiment of the present disclosure.

FIG. 23 illustrates a top view of the female buckle member 400, according to an embodiment of the present disclosure. As shown in FIG. 23, the retaining spades 414 extend inwardly from positions proximate to the four corners of the base 402 and toward a central vertical axis 416 of the female buckle member 400.

Figure 24:
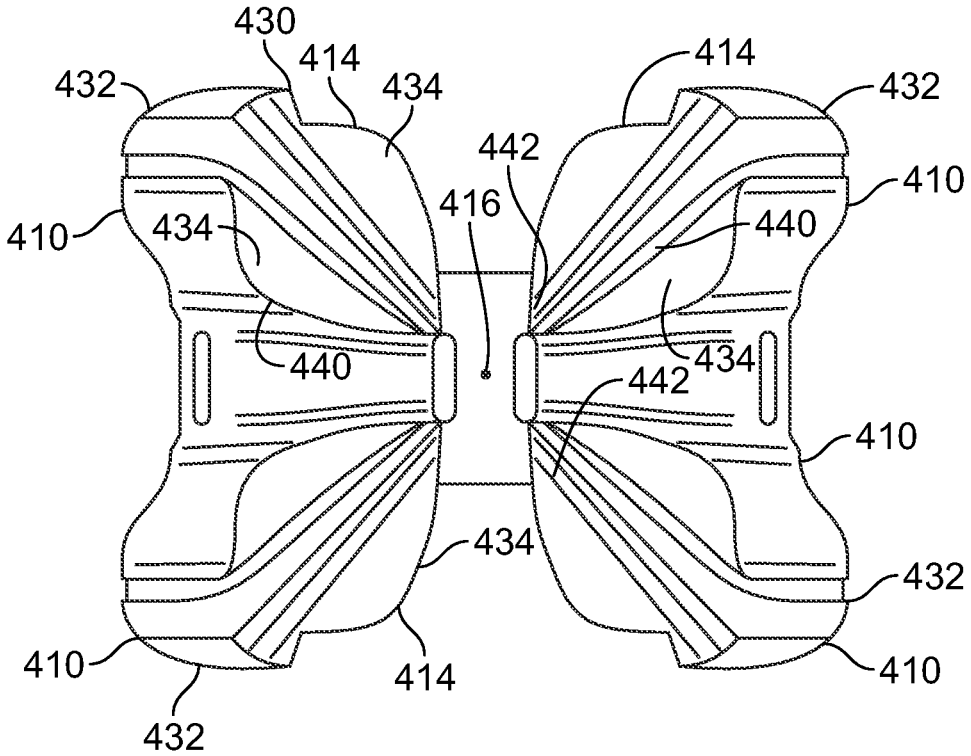
FIG. 24 illustrates a bottom view of a female buckle member, according to an embodiment of the present disclosure.

FIG. 24 illustrates a bottom view of the female buckle member 400, according to an embodiment of the present disclosure. Each retaining spade 414 may include a central rib 430 extending through a length thereof. The central rib 430 may taper down from an outer edge 432 toward the central vertical axis 416. Side fins 434 expand outwardly from the outer edge 432 about the central rib 430 toward a mid-section 440. The side fins 434 taper back down from the mid-section 440 toward a distal tip 442. As such, the retaining spades 414 may be shaped as spades, leaves, or the like. The shape of the retaining spades 414 allows webbing to be inserted into and adjustably secured within web passages aligned with either the longitudinal or lateral axes of the female buckle member 400.

Alternatively, instead of retaining spades, four posts may extend downwardly from the base 402 and connect to a planar web plate that is parallel with the base 402. In this manner, perpendicular web passages may be formed, such that one is parallel with the longitudinal axis, and the other is parallel with the lateral axis. However, in this embodiment, webbing may not be quickly and easily inserted into the web passages. Instead, a first end of the webbing would be inserted into a web passage, and eventually connected to an opposite end of the webbing.

Figure 25:
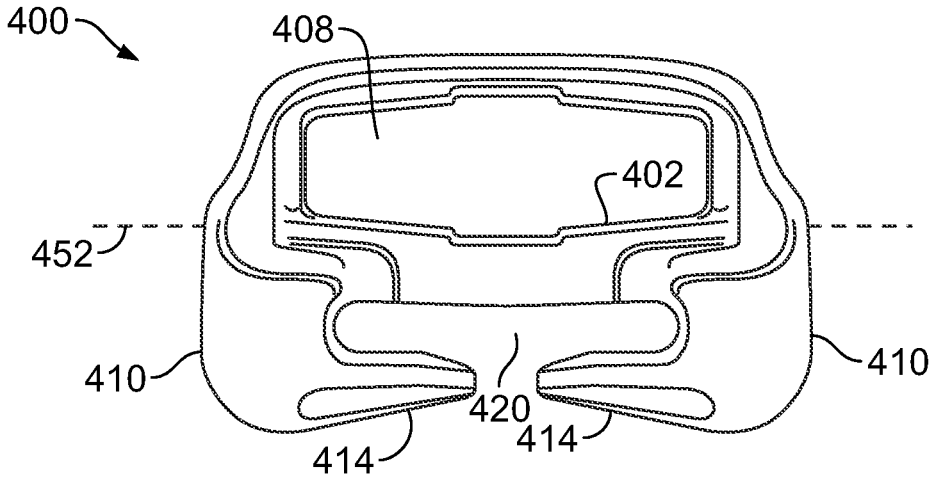
FIG. 25 illustrates an end view of a female buckle member, according to an embodiment of the present disclosure.

FIG. 25 illustrates an end view of the female buckle member 400, according to an embodiment of the present disclosure. The web-retaining channels 420 are formed between the web-retainers 410 and the base 402 at the ends 422 (shown in FIG. 22). As such, webbing may be adjustably secured through the ends 422 of the female buckle member 400.

Figure 26:
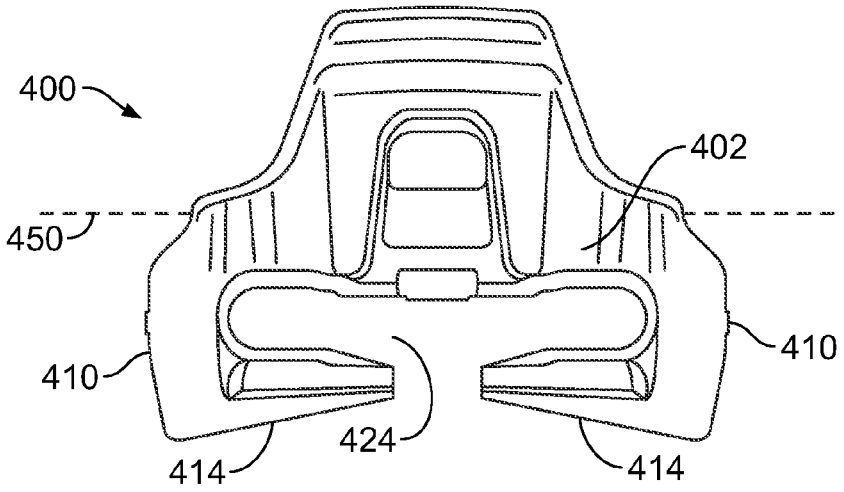
FIG. 26 illustrates a lateral view of a female buckle member, according to an embodiment of the present disclosure.

FIG. 26 illustrates a lateral view of the female buckle member 400, according to an embodiment of the present disclosure. The web-retaining channels 424 are formed between the web-retainers 410 and the base 402 at the sides 426 of the female buckle member 400. Accordingly, webbing may be adjustably secured through the sides 426 (shown in FIG. 22) of the female buckle member 400. Referring to FIGS. 25 and 26, unlike previously-known buckle members, the female buckle member 400 may be adjustably secured with respect to webbing along longitudinal or lateral axes 450 and 452, respectively.

Figure 27:
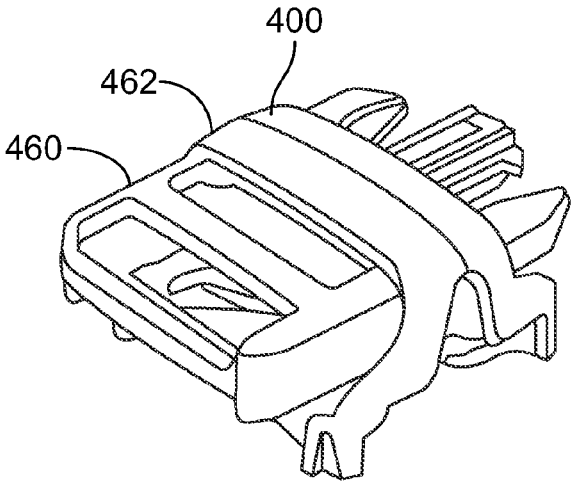
FIG. 27 illustrates an isometric top view of a female buckle member securely retaining a male buckle member from a first end, according to an embodiment of the present disclosure.
Figure 28:
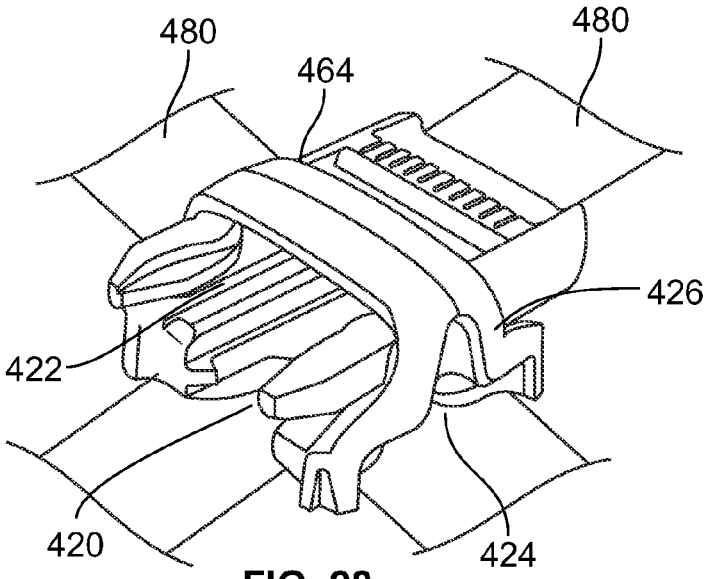
FIG. 28 illustrates an isometric top view of a female buckle member securely retaining a male buckle member from a second end, according to an embodiment of the present disclosure.

FIG. 27 illustrates an isometric top view of the female buckle member 400 securely retaining a male buckle member 460 from a first end 462, according to an embodiment of the present disclosure. FIG. 28 illustrates an isometric top view of the female buckle member 400 securely retaining the male buckle member 460 from a second end 464, according to an embodiment of the present disclosure. Referring to FIGS. 27 and 28, the female buckle member 400 may receive and retain the male buckle member 460 through either end 462 or 464, as described above. Further, the female buckle member 400 may be adjustably secured with respect to webbing 480 that passes through web-retaining channels 420 formed through the ends 422 and/or web-retaining channels 424 that pass through the sides 426.

Figure 29:
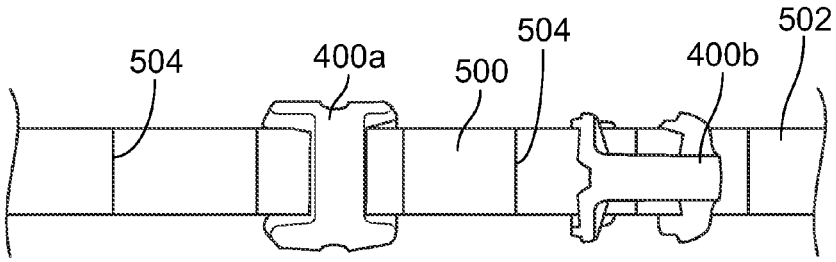
FIG. 29 illustrates a front view of a female buckle members secured to webbing of a component, according to an embodiment of the present disclosure.

FIG. 29 illustrates a front view of female buckle members **400*a* and 400*b* secured to webbing 500 of a component 502, according to an embodiment of the present disclosure. The webbing 500 may be PALS webbing having stitches 504 that secure the webbing 500 to fabric, such as that of a backpack, tactical vest, or the like. The female buckle member 400*a* is shown adjustably secured to the webbing 500 passing through the ends of the female buckle member 400*a*. The female buckle member 400*b* is shown adjustably secured to the webbing 500, across a stitch 504, such that the webbing 500 passes through sides of the female buckle member 400*b*. Each of the female buckle members 400*a* and 400*b*** may receive and retain a male buckle member through either end, as described above.

As shown in FIGS. 22-29, for example, embodiments of the present disclosure provide a 4-way female buckle member 400 that is configured to receive and securely retain a male buckle member from either end, while adjustably retaining webbing along longitudinal or lateral axes. The female buckle member 400 may securely receive webbing through either end, or either side. As such, the female buckle member 400 may receive and retain webbing from four different directions, as shown in FIG. 28, for example.

Embodiments of the present disclosure provide a multi-directional web-mounted side release buckle housing having a low profile. Accordingly, embodiments of the present disclosure provide greater flexibility when orienting buckle members. Additionally, embodiments of the present disclosure provide a female buckle member including a housing having less material than many known female buckle members.

The web-retainers 410 having the retaining spades 414 may be used with any of the embodiments of the present disclosure, including any of the embodiments shown and described with respect to FIGS. 1-29.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present disclosure. It is understood that the embodiments disclosed and defined herein extend to all alternative combinations of two or more of the individual features mentioned or evident from the text and/or drawings. All of these different combinations constitute various alternative aspects of the present disclosure. The embodiments described herein explain the best modes known for practicing the disclosure and will enable others skilled in the art to utilize the disclosure. The claims are to be construed to include alternative embodiments to the extent permitted by the prior art.

Various features of the disclosure are set forth in the following claims.

The invention claimed is:

1. A female buckle member configured to securely mate with a male buckle member, the female buckle member comprising:

a housing including a base connected to opposed lateral walls and an upper wall, wherein an insertion channel is defined between the base, the opposed lateral walls, and an upper wall, wherein first and second ends of the housing have the same size and shape, and wherein the first and second ends are configured to receive an insertion end of a male buckle member; and a plurality of web-retainers extending from the base, wherein the plurality of web-retainers are configured to adjustably retain webbing.

2. The female buckle member of claim 1, further comprising at least one male lock member extending from the base, wherein the at least one male lock member is configured to securely connect to a reciprocal feature of the male buckle member.

3. The female buckle member of claim 2, wherein the at least one male lock member comprises two opposed male lock members extending toward one another from the opposed lateral walls.

4. The female buckle member of claim 2, wherein the at least one male lock member comprises rounded corners connected to an exposed end.

5. The female buckle member of claim 1, wherein the plurality of web-retainers define web-retaining channels formed through the first and second ends of the housing.

6. The female buckle member of claim 1, wherein the plurality of web-retainers define web-retaining channels formed through first and second sides of the housing.

7. The female buckle member of claim 1, wherein each of the plurality of web-retainers includes an extension beam connected to the base and a cross beam extending inwardly from the extension beam.

8. The female buckle member of claim 1, wherein each of the plurality of web-retainers includes a retaining spade extending toward a central axis of the housing.

9. A female buckle member configured to securely mate with a male buckle member, the female buckle member comprising:

a housing having first and second ends, first and second sides, and a base; and a plurality of web-retainers extending from the base, wherein the plurality of web-retainers define a first web-retaining channel configured to adjustably retain webbing extending between the first and second ends, and a second web-retaining channel configured to adjustably retain webbing extending between the first and second sides, wherein the first web-retaining channel is parallel to one of a longitudinal or lateral axis of the housing, and wherein the second web-retaining channel is parallel to the other of the longitudinal or lateral axis of the housing.

10. The female buckle member of claim 9, wherein the housing further comprises opposed lateral walls connected to the base, and an upper wall connected to the lateral walls, wherein an insertion channel is defined between the base, the opposed lateral walls, and an upper wall.

11. The female buckle member of claim 9, further comprising at least one male lock member extending from the base, wherein the at least one male lock member is configured to securely connect to a reciprocal feature of the male buckle member.

12. The female buckle member of claim 9, wherein each of the plurality of web-retainers includes a retaining spade extending toward a central axis of the housing.

13. The female buckle member of claim 12, wherein the retaining spade comprises a central rib and side fins on either side of the central rib.

14. The female buckle member of claim 13, wherein the central rib tapers down from an outer edge to a distal tip, and wherein each of the side fins is widest proximate to a mid-section of the retaining spade.

15. A female buckle member configured to securely mate with a male buckle member and adjustably retain webbing through multiple directions, the female buckle member comprising:

a housing having first and second ends and first and second sides, the housing comprising a base connected to opposed lateral walls and an upper wall, wherein an insertion channel is defined between the base, the opposed lateral walls, and an upper wall, wherein the housing is symmetrical about longitudinal and lateral axes, wherein the first and second ends of the housing have the same size and shape, and wherein the first and second ends are configured to receive an insertion end of a male buckle member; and a plurality of web-retainers extending from the base, wherein the plurality of web-retainers define a first web-retaining channel configured to adjustably retain webbing extending between the first and second ends, and a second web-retaining channel configured to adjustably retain webbing extending between the first and second sides, wherein the first web-retaining channel is parallel to one of the longitudinal or lateral axis of the housing, and wherein the second web-retaining channel is parallel to the other of the longitudinal or lateral axis of the housing.

16. The female buckle member of claim 15, further comprising two opposed male lock members extending from the base and toward one another from the opposed lateral walls.

17. The female buckle member of claim 15, wherein each of the plurality of web-retainers includes a retaining spade extending toward a central axis of the housing.

18. The female buckle member of claim 17, wherein the retaining spade comprises a central rib and side fins on either side of the central rib.

19. The female buckle member of claim 18, wherein the central rib tapers down from an outer edge to a distal tip, and wherein each of the side fins is widest proximate to a mid-section of the retaining spade.

* * * * *